US006864853B2

(12) United States Patent
Judd et al.

(10) Patent No.: US 6,864,853 B2
(45) Date of Patent: Mar. 8, 2005

(54) COMBINATION DIRECTIONAL/ OMNIDIRECTIONAL ANTENNA

(75) Inventors: Mano D. Judd, Rockwall, TX (US); David B. Webb, Dallas, TX (US); Jonathon C. Veihl, McKinney, TX (US)

(73) Assignee: Andrew Corporation, Orland Park, IL (US)

( * ) Notice: Subject to any disclaimer, the term of this patent is extended or adjusted under 35 U.S.C. 154(b) by 58 days.

(21) Appl. No.: 09/999,242

(22) Filed: Oct. 31, 2001

(65) Prior Publication Data

US 2002/0113743 A1 Aug. 22, 2002

Related U.S. Application Data

(63) Continuation-in-part of application No. 09/687,320, filed on Oct. 13, 2000, now Pat. No. 6,448,930, which is a continuation-in-part of application No. 09/483,649, filed on Jan. 14, 2000, now abandoned, and a continuation-in-part of application No. 09/418,737, filed on Oct. 15, 1999, now Pat. No. 6,160,514.

(60) Provisional application No. 60/245,009, filed on Nov. 1, 2000.

(51) Int. Cl.[7] ..... H01Q 9/16; H01Q 21/00

(52) U.S. Cl. ..... 343/844; 343/700 MS; 343/792; 343/853; 343/773

(58) Field of Search ..... 343/700 MS, 725, 343/844, 853, 773, 793, 790, 791, 792, 810, 893, 891, 375

(56) References Cited

U.S. PATENT DOCUMENTS

| | | | | | |
|---|---|---|---|---|---|
| 2,866,194 | A | | 12/1958 | Stavis et al. | 343/725 |
| 4,162,499 | A | | 7/1979 | Jones, Jr. et al. | 343/700 |
| 4,527,163 | A | | 7/1985 | Stanton | 343/700 |
| 4,605,932 | A | | 8/1986 | Butscher et al. | 343/700 |
| 4,963,879 | A | * | 10/1990 | Lin | 343/792 |
| 4,980,692 | A | * | 12/1990 | Rudish et al. | 343/700 MS |
| 5,105,199 | A | * | 4/1992 | Ukmar | 343/791 |
| 5,243,354 | A | | 9/1993 | Stern et al. | 343/700 |
| 5,291,211 | A | | 3/1994 | Tropper | 343/890 |
| 5,345,247 | A | * | 9/1994 | Aldama et al. | 343/791 |
| 6,067,053 | A | | 5/2000 | Runyon et al. | 343/797 |
| 6,141,335 | A | | 10/2000 | Kuwahara et al. | 370/342 |
| 6,160,514 | A | | 12/2000 | Judd | 343/700 |
| 6,172,654 | B1 | * | 1/2001 | Martek | 343/893 |
| 6,198,460 | B1 | | 3/2001 | Brankovic | 343/879 |
| 6,222,502 | B1 | | 4/2001 | Falbo et al. | 343/879 |
| 6,483,471 | B1 | * | 11/2002 | Petros | 343/725 |

* cited by examiner

*Primary Examiner*—Tan Ho
(74) *Attorney, Agent, or Firm*—Wood, Herron & Evans, LLP

(57) ABSTRACT

A combined directional beam and omnidirectional antenna comprises a unitary structure having a plurality of antennas being configured and oriented to achieve both directional beam coverage and omnidirectional beam coverage.

50 Claims, 7 Drawing Sheets

COMBINATION DIRECTIONAL/ OMNIDIRECTIONAL ANTENNA

CROSS REFERENCE TO RELATED APPLICATION

This application claims the benefit of the priority date of U.S. Provisional application, Ser. No. 60/245,009, filed Nov. 1, 2000, and this application, is a continuation-in-part application of a U.S. patent application, Ser. No. 09/687,320, filed on Oct. 13, 2000, entitled "Indoor Antenna," which is now U.S. Pat. No. 6,448,930, a continuation-in-part of U.S. patent application Ser. No. 09/483,649, filed Jan. 14, 2000, entitled "RF Switched Beam Planar Antenna," now abandoned, and of U.S. patent application Ser. No. 09/418,737, filed Oct. 15, 1999, entitled "L-Shaped Indoor Antenna," and now U.S. Pat. No. 6,160,514. The disclosures of these applications and issued patent(s) are incorporated herein by reference in their entireties.

FIELD OF THE INVENTION

This application relates generally to wireless communications, and specifically to an antenna system for same.

BACKGROUND OF THE INVENTION

In conventional cellular and PCS (Personal Communications System) wireless systems, signals transmitted from a base station (cell site) to a user (remote terminal) are usually received via an omnidirectional antenna; often in the form of a stub antenna. Such systems often sacrifice bandwidth to obtain better area coverage, stemming from the result of less-than-desirable signal popagation characteristics. For instance, the bit binary digit-to-Hz ration of the typical digital cellular or PCS system is often less than 0.5. Lower binary signal modulation types, such as BPSK (Binary Phase Shift Keying) are used, since the effective SNR (Signal to Noise Ratio) or C/I (Carrier to Interference Ratio) are often as low as 20 dB. In fact, for voice-based signaling, the threshold C/I (or SNR) ratio (SNR) for adequate quality reception of the signal is about 17 dB. Conventional omnidirectional antennas do not provide either enough bandwidth or enough gain for applications involving broadband services, such as Internet data and the like. In order to achieve more gain, with the goal being at least 6 dBi (isotropic) some other alternative is necessary. In this regard, some providers require from as much as 10 to 20 dBi directional gain for customer equipment.

Data applications require higher C/I characteristics. For example, for wireless systems directed toward data applications, it is desirable to significantly increase the SNR or C/I in order to employ higher order modulation techniques, such as a QAM-64 (Quadrature Amplitude Modulation, with 64 points in the complex constellation). These higher order modulation schemes require substantially greater C/I (or SNR) thresholds; typically higher than 26 dB. For the case of MMDS (Multichannel Multipoint Distribution System) signals, where the carrier frequencies are higher (around 2500 MHz), the propagation characteristics are even worse. There is a need, therefore, for transmission systems that can both satisfy the coverage (progagation) demands, as well as generate high C/I or SNR levels, such as for data applications.

One option for improving C/I characteristics is to increase the terminal equipment (TE), or remote, antenna gain. This requires increasing the physical size of the antenna.

Additionally, it helps to increase the elevation (i.e., vertical height above ground level) of the antenna, if that is an available option.

For example, in conventional analog MMDS systems, an increase of SNR or C/I has been traditionally accomplished by installing a large reflector type antenna or flat plate array (with up to 30 dBi of directional gain) on a rooftop, or a pole. The disadvantages of such a solution include a complex, difficult, and costly installation, as well as poor aesthetics. The migration of the MMDS frequency spectrum, however, from an analog video system to a wireless data and Internet system, demands a less complex and more user friendly antenna installation method. It also demands a much lower cost. The difficulty in such a solution is in designing a system with sufficient directional gain to overcome losses in transmission through walls, and which is also easy to install and orient without requiring specialized skills by the consumer or others.

Simultaneously, in wireless communications using cellular phones or other consumer-based, Customer Premises Equipment (CPE), there is also a need for similar types of antennas and systems. More specifically, CPE antenna systems with directional characteristics or beamsteering for added gain and C/I improvement are desirable. An omnidirectional mode of operation is also still desirable, as well. For example, it may be desirable to scan omnidirectionally for other incoming signals while simultaneously receiving/transmitting a given signal from/to a given direction with increased gain provided by beamsteering or a beam shaping of an antenna to the direction of the incoming/outgoing signal.

Accordingly, it is desirable to have an antenna system which provides desirable C/I characteristics, such as for wireless data systems.

Simultaneously, it is also desirable to maintain omnidirectional characteristics for good area coverage.

The present invention addresses these and other needs in the art as discussed below in greater detail.

The above-mentioned omnidirectional and beam steering antenna, which is more fully described hereinbelow, provides a simple and inexpensive solution to the above-discussed problems.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE ILLUSTRATED EMBODIMENTS

Figure 1:
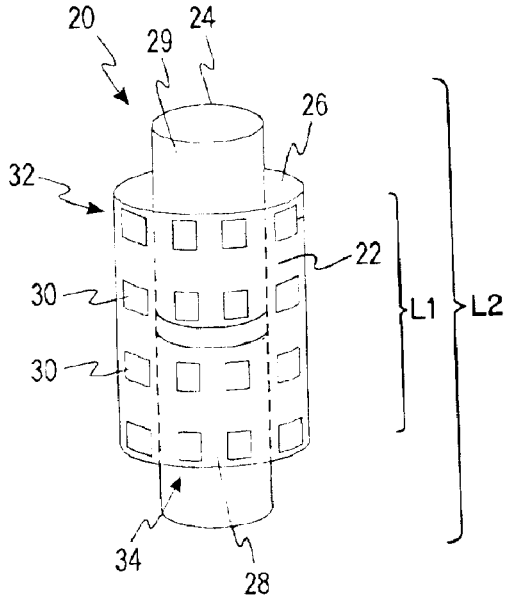
FIG. 1 is a perspective view showing an antenna in accordance with one embodiment of the invention.
Figure 2:
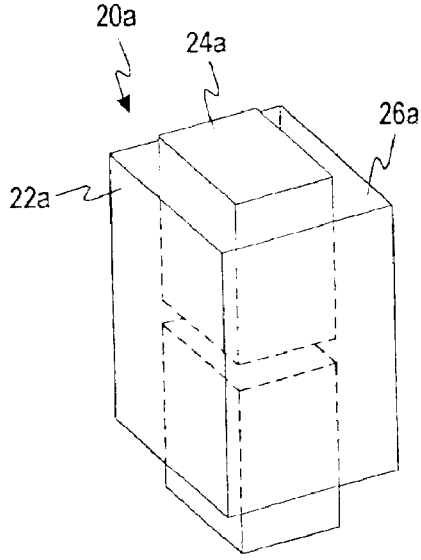
FIG. 2 is a view similar to FIG. 1, showing an alternate embodiment of an inventive antenna.

Referring to the drawings and initially to FIG. 1, an embodiment of a combined directive beam (or steered beam) and omnidirectional antenna system in accordance with one aspect of the invention is designated generally by the reference numeral 20. The antenna system 20 has two antenna elements or antennas cooperating to provide the desired features of the invention, including directional beam coverage and omnidirectional beam coverage. A directive beam antenna 22 forms an outer antenna or outer surface of the antenna system 20. An omnidirectional antenna 24, which is described below, is an inner antenna and is positioned central to antenna 22. The omnidirectional antenna 24 may comprise a dipole element or elements, as discussed below, or alternatively might be a monopole. A spacer material 26 of a suitable form may be employed between the respective antenna systems 22 and 24. In the embodiment of FIG. 1, the cooperating antenna systems 22 and 24 are arranged generally as hollow cylinders having generally circular cross-sections. However, other hollow tubular configurations, such as ones having polygonal or square cross-sections might be use. A generally square cross-section embodiment is indicated in FIG. 2, with the respective parts being designated by like reference numerals with the suffix "a." The electronics or other components associated with the antenna, such as signal processing electronics (not shown) may be stored in a central space inside of the inner antenna 24.

The antenna system 20 is in the form of a "unitary" structure wherein the antennas 22, 24 operate together. Preferably, the antennas 22, 24 might be physically coupled together to be mounted as a unitary structure and to operate that way. The term "unitary" as used herein does not require that both antennas be physically coupled or be formed or molded together. Rather, they might be fabricated separately and then mounted to operate together in unison.

The directive beam antenna 22 may be formed from a variety of suitable materials, such as a flexible sheet of Mylar or other flexible material 28 rolled into a cylinder. Antenna 22 has an array of individual antenna elements 30 formed, deposited, or otherwise mounted thereon. For example, a sheet of flexible Mylar material may have a number of microstrip/patch antenna elements 30 etched thereupon, as illustrated in FIG. 1. It will be noted in the embodiment of FIG. 1 that the axial length L1 of the directive beam antenna 22, and particularly of the rolled Mylar sheet 28, is less than the axial length L2 of the omnidirectional antenna 24, so that opposite ends of the antenna 24 project outwardly at opposite ends of the antenna 22. In the embodiment illustrated in FIG. 1, the patch or other antenna elements 30 are arranged in a generally symmetrical array having M rows 32 or N columns 34. In FIG. 1, the columns and rows of elements 30 are shown generally aligned in a linear fashion. However, they could be staggered as well in their placement on antenna 22. The antenna elements 30 may be suitable antenna elements, such as monopoles, dipoles, horns, radiating slots or apertures or any other type of radiating element, as known to a person of ordinary skill in the art for the purposes of directive beam forming and beam steering. The antenna elements 30 may be vertically or horizontally polarized, as desired.

The directive beam antenna 22, and specifically the elements 30, may use the antenna 24 as a ground plane. For example, antenna 24, and specifically an outer surface 29 of antenna 24, may be a ground plane for patch antenna elements 30. Simultaneously, antenna 24 may act as a cylindrical dipole antenna (parasitized by the patches 30).

FIGS. 3, 4, 4A, and 4B show control systems which act as various beam selection systems or beamsteering systems which may be utilized to control the antenna system and to control one or more of the columns 34 and rows 32 of the array of antenna elements 30 to form directed or steered beams, or to select omnidirectional antenna 24. Alternatively, both the omnidirectional antenna 24 and the directive beam antenna 22 may be selected and controlled simultaneously. Still further, selected direction beams may be selected and controlled. Therefore, the invention may have a directional beam only mode, an omnidirectional beam only mode, or a directional and omnidirectional beam mode simultaneously. Also, when the direction beam mode is chosen, one or more of the directional beams may be selected. The individual beams defined by the M×N array may be selected and controlled or steered by methods known to those of ordinary skill in the art. The individual beams may be selectively utilized to provide the directional aspects of the invention.

Figure 3:
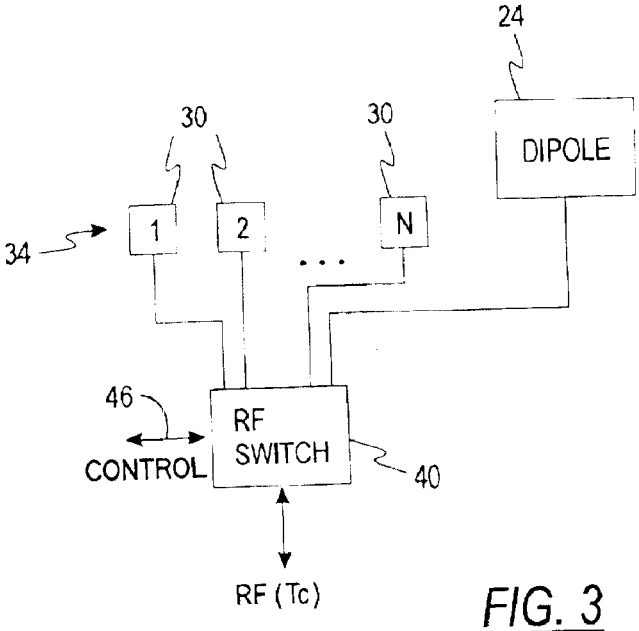
FIG. 3 shows a beamsteering or beam selection systems which may be used in accordance with aspects of the invention.

In FIG. 3 a single radio frequency (RF) switch 40 is utilized for selecting one or the other of the directional and omnidirectional features of the invention. The output of the RF switch 40 is coupled to a transceiver (Tc) based on the control 46 of the switch. Control lines or inputs 46 may be provided for the RF switches and controlled via suitable electronics and other circuitry (not shown). Through the control inputs 46 and the switching systems, selective ones of the beams formed by antenna 22 may be selected.

Figure 4:
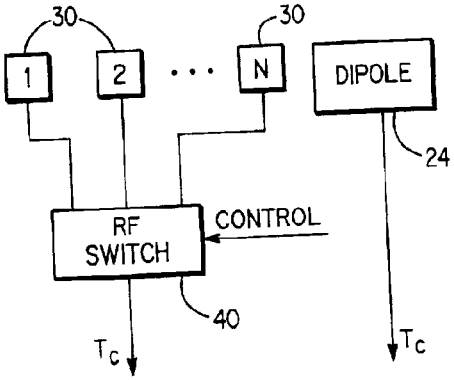
FIGS. 4, 4A and 4B illustrate alternative beamsteering or beam selection systems which may be used in accordance with aspects of the invention.
Figure 4A:
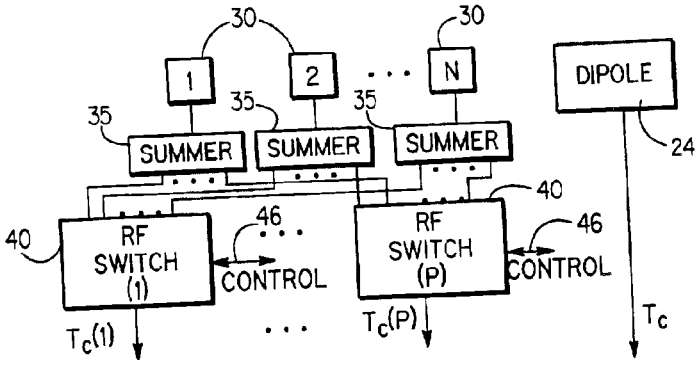

In FIG. 4, both the directional aspects and omnidirectional aspects of the invention may be utilized simultaneously. RF Switch 40 and appropriate controls 46 may be used to realize the directional features. The output of the omnidirectional antenna 24, such as a dipole, is separately directed to a transceiver Tc. In that way, one of the directional beams form a column 1-N might be chosen in addition to the omnidirectional beam. In FIG. 4A, up to P simultaneous directional beams might be selected in addition to the omnidirectional beam. To that end, signals associated with the columns 1-N of elements 30 are directed to a summer/splitter network 35 whereby the output of the columns are each input to a series of 1-P RF switches 40 which are coupled to appropriate control circuitry 46. The outputs of the 1-P switches are directed to a series of transceivers Tc(1) to Tc(P). The number of switches P would generally be equal to or less than the number of columns N or directional beams which might be utilized. In FIG. 4A, if desired, one or more of the directional beams may be utilized simultaneously with the omnidirectional beam.

Specifically, this might involve selecting certain columns of the array elements. Also, through the switching system and appropriate controls 46, beamsteering might be accomplished through antenna 22 by controlled beam selection. Advantageously, all of the electronics and other circuitry for the antenna 20 may be located inside of the hollow cylinder 24 which forms the omnidirectional antenna 24.

Figure 4B:
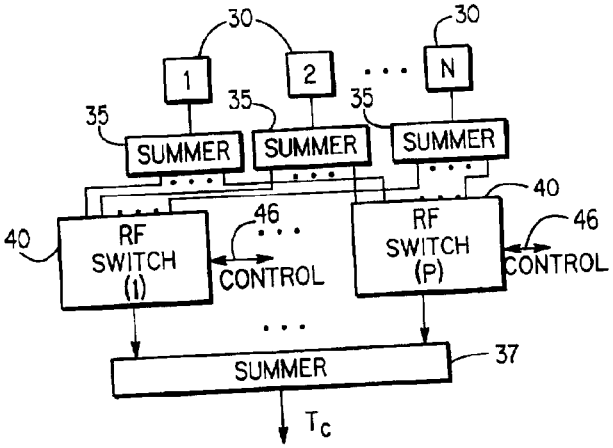

FIG. 4B illustrates a system which, alternatively, provides for a combination of the outputs from one or more of the N selectable directional beams. To that end, the outputs 1-P from the RF switches 40 are directed to an appropriate summer/splitter network 37 so that at least two of the selectable directional beams N may be combined and routed appropriately to a transceiver Tc. As will be understood by a person of ordinary skill in the art, additional summer/splitter networks might be utilized with additional transceivers for processing various beam combinations through selective switch routing to the transceivers.

Figure 5:
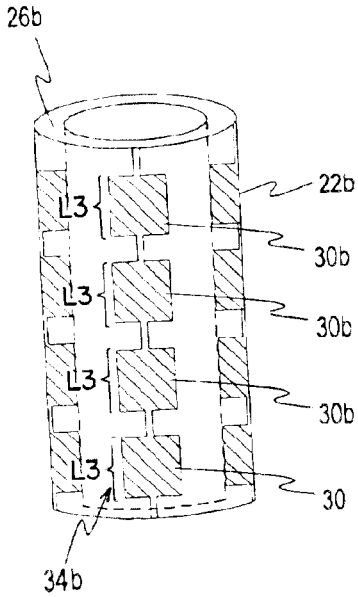
FIG. 5 is a view similar to FIG. 1 showing an alternative embodiment of the invention.

FIG. 5 illustrates another embodiment of the directive beam antenna 22*b*. The antenna 22*b* is formed as a cylindrical element with series fed microstrip columnar arrays 34*b*. The arrays 34*b* comprise vertical columns of patch elements 30*b* illustrated. In the illustrated embodiments, the patch elements 30*b* are shown as vertically polarized and are intended to resonate at the same frequency. The vertical patch dimensions L3 are identical in one embodiment. Alternatively, patches of different dimensions might be utilized to obtain dual or multi-frequency band operation for antenna 24*b*. The switching arrangements of FIGS. 3 and 4 may be configured and operated as noted, so as to produce a directive beam antenna by selecting one or more of the columns 34 of antenna elements 30, or an omnidirectional beam by selecting the omnidirectional antenna 24, or to operate to select both a directive beam and omnidirectional beam, simultaneously.

In the embodiment of FIG. 5, the omnidirectional antenna would be surrounded by the directive beam antenna 22*b* with elements 30*b*. A spacer material 26*b* is positioned therebetween, as shown. In such a case, the omnidirectional antenna, which may be a dipole array as discussed below, is used as a ground plane for the array of elements 30*b*. The elements 30*b* may be either vertically or horizontally polarized, or rotated to some other orientation. While a serial feed is illustrated, any other suitable feed method might be utilized, such as a corporate feed, hybrid corporate feed, resonant feed, etc. The interior space inside of omnidirectional antenna 24, 24*a*, might be used to house the feeding network and other electronic components, as noted above.

Figure 6:
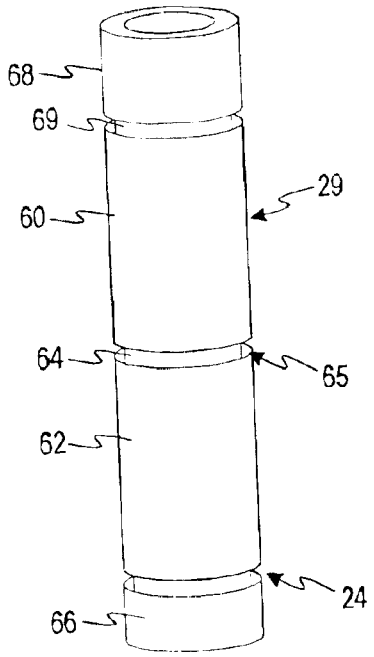
FIG. 6 is a perspective view of a dipole antenna element or portion which may be utilized in conjunction with the antenna embodiment of FIG. 1.

FIG. 6 shows an embodiment of an omnidirectional antenna element 24, suitable for one embodiment of antenna system 20. In the embodiment of FIG. 6, the antenna 24 is a dipole antenna with two individual dipole arms 60, 62. These dipole arms 60, 62 are generally hollow and tubular. In the illustrated embodiment, the arms 60, 62 are cylindrical metallic elements. These elements may be formed of metallic material or may be molded from a plastic material with a metal coated on their outer surfaces. Thus, for example, the outer metallic surface 29 of the dipole antenna 24 may conveniently act as a ground plane for the patch antenna elements 30, 30*b*, as discussed above. In the embodiment shown in FIG. 6, the two cylindrical dipole arms 60 and 62 are separated by a small gap or space 64 which may also be occupied by a dielectric spacer, if desired. The small gap or space 64 defines a feedpoint for the dipole antenna 24. Opposite end portions of the dipole arms 60 and 62 may be capped by short, cylindrical or tubular caps 66, 68 which provide capacitive end loading. This capacitive end loading enables the use of the antenna 24 at lower frequencies without increasing the length thereof, as would normally be required. That is, generally speaking, the size of the antenna element increases with decreasing frequency. The antenna 24 will have a somewhat shorter length than a half-wave dipole, due to the capacitive loading at the ends.

It will be noted that the arms or cylinders 60 and 62 forming the dipole antenna 24, as well as the end caps 66 and 68, are of like cross-sectional external dimensions or diameter, as in the case of the cylindrical antenna shown in FIG. 6 and are generally coaxially aligned.

Figure 7:
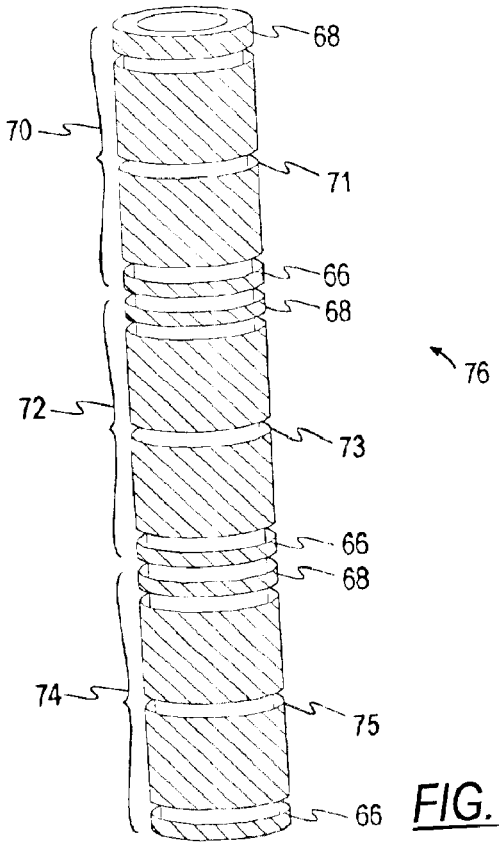
FIG. 7 is a perspective view of a n alternative embodiment of the dipole antenna of FIG. 6.

The dipole arms 60, 62 are structurally held in the desired configurations, as illustrated in FIGS. 6 and 7, for example, by suitable support structures. For example, a support structure 69 may extend through the center of the arms 60, 62 and caps 66, 68, and be mechanically coupled to those elements to form the dipole antenna 24. The arms 60, 62 and caps 66, 68 may be maintained to operate as a generally unitary structure by any suitable mounting means.

Figure 6A:
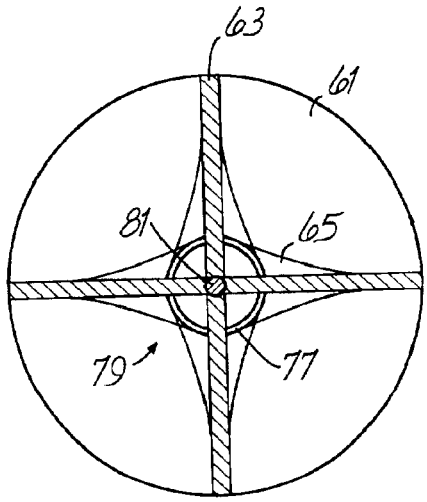
FIG. 6A is a top view of a feed system for use with an antenna in accordance with the aspects of the invention.

FIG. 6A illustrates one possible feed system for the dipole antenna 24 which will interface with the antenna 24 proximate to feedpoint 64. A thin sheet of substrate material 61 has a twin line feed etched thereon including a top conductor 63 and a bottom conductor 65. Substrate 61 is mounted, in one embodiment, proximate feed point 64, and generally perpendicular to the axis of the cylindrical dipole arms 60, 62. FIG. 6A shows a top view of the substrate which is circular to coincide with the circular cross-section of the antenna embodiments shown in FIGS. 1, 6, and 7. Other shapes might also be utilized, as desired, to feed antenna 24. The opposing feed lines or conductors 63, 65 are electrically coupled (e.g. by soldering) to the dipole arms 60, 62, respectively. The bottom conductor 65 may include an appropriate balun region, as shown, for coupling to a shield 77 of a coaxial cable 79 coupled to the feed system. The top conductor 63 is coupled to a center conductor 81 of the coaxial cable 79.

The feed lines 63, 65 are formed in a pattern in FIG. 6A to feed the dipole arms 60, 62 at multiple symmetric points around the cylindrically-shaped arms. Specifically, the feed points are illustrated at 90° increments around the cylinder, although a greater or lesser number of feed points may be utilized as desired. The illustrated embodiment of FIG. 6A is configured to address asymmetry in the feed. While one type of feed is illustrated, other dipole feed embodiments might be utilized as known to a person of ordinary skill in the art.

FIG. 7 shows an array 76 of dipole antennas, or antenna elements coupled together as a generally unitary structure. In the Figure, three dipoles 70, 72, and 74, each of the general configuration shown in FIG. 6, are shown positioned end-to-end. In FIG. 7, the dipole antennas 70, 72, 74 are shown stacked vertically in array 76 where the antennas 70, 72, 74 are generally coaxial. More or fewer antennas may be employed, depending upon the desired gain for array 76. It is estimated that the three elements 70, 72 and 74 shown in FIG. 7 will produce approximately 6 dBi of gain. Moreover, the capacitive and loading caps 66, 68 may either be electrically isolated, or may be electrically tied together, such as with a conductor (not shown). Feedpoints 71, 73 and 75 may be provided at midpoints of the respective dipole antennas 70, 72, and 74, similar to the central feedpoint 64 provided in the dipole structure of FIG. 6. A feed system as shown in FIG. 6A might be utilized for the dipole elements of FIG. 7, as might other suitable feed systems.

Referring now to FIGS. 8–12, a further embodiment of a combined omnidirectional beam and directive beam antenna system is illustrated and designated by the reference numeral 80. The antenna system 80 is formed from a plurality or array of bi-conical reflector elements 82, 84, 86 and 88. While the illustrated embodiment shows four elements, a greater or less number of elements might also be utilized. This configuration is theoretically more efficient than the linear dipole arrays of FIGS. 6 and 7. Each of the bi-conical elements 82–88 comprises two oppositely facing frusto-conical reflector portions. That is, the bases of frusto-conical portions face away from each other and the tops of the portions coincide. For example, the two portions of each of the elements 82–88 are indicated by reference numerals of 90 and 92 in FIG. 8. The bi-conical elements 82–88 formed by the cooperating portions 90, 92, are illustrated stacked end-to-end, and generally coaxial with each other.

Figure 8:
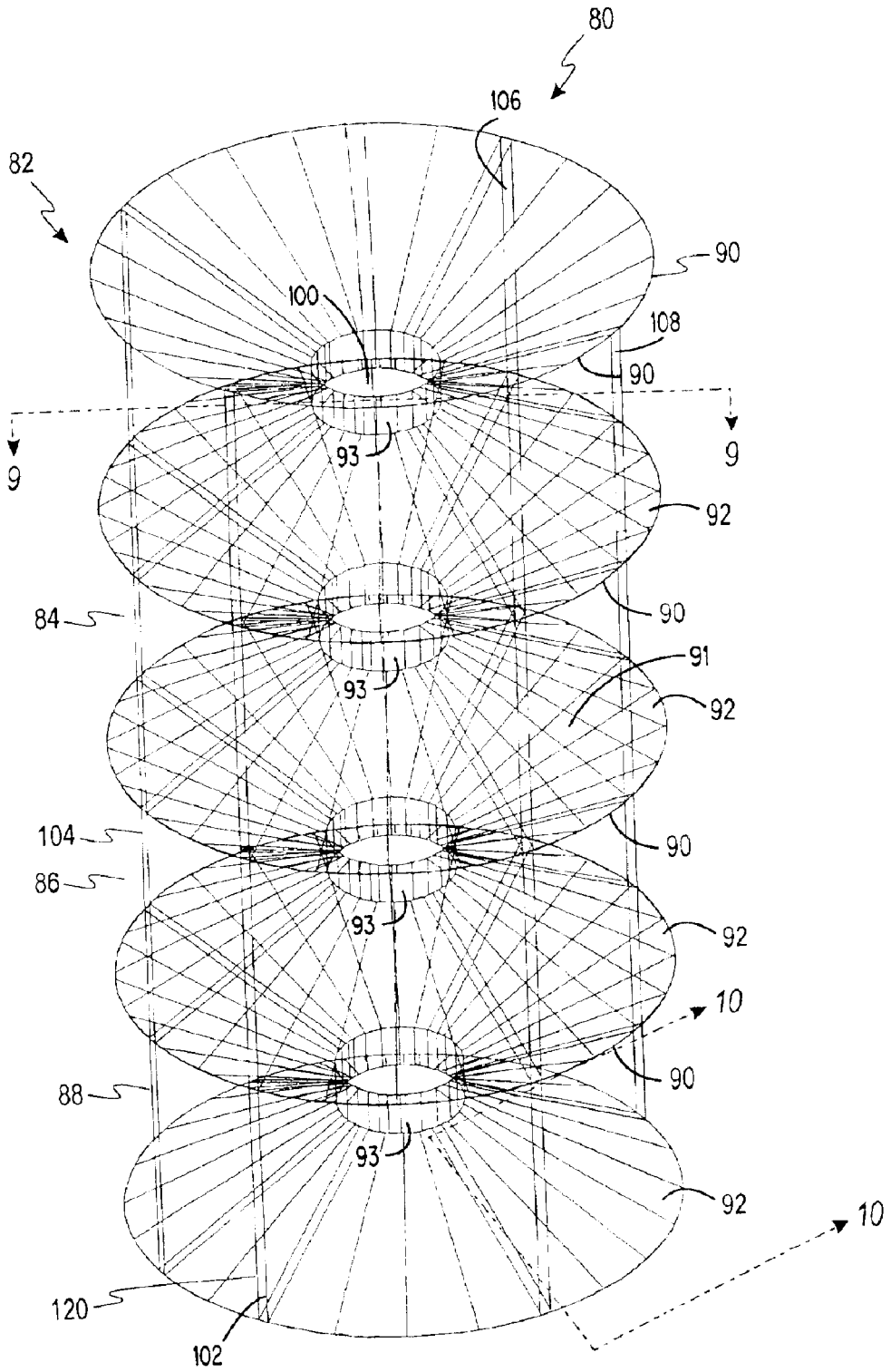
FIG. 8 is a perspective view in accordance with another embodiment of the present invention.

As noted, these bi-conical array systems 80 are more efficient than the linear dipole arrays of FIGS. 6 and 7, for example, allowing a comparable gain in about half of the axial length of the system. For example, one of the arrays as shown in FIG. 8 may be about the size of a soda can, for example, about 4.8 inches tall by about 2.6 inches diameter, yet have as much as 6.4 dBi directivity for omnidirectional coverage. A circuit card may be readily mounted for electronics intermediate the respective elements 82–88, or at the top or bottom of the array, and housed within the frusto-conical interior space of one or more of the frustoconical reflector portions 90, 92.

The open tops of the frusto-conical portions 90, 92 coincide with a ring portion 93 as illustrated, and the portions 93 and 90, 92 are coaxially aligned to form a central passageway 100 through which feed lines, such as one or more coaxial cables or the like, may pass to provide a feed system, (not shown in FIG. 8) for the respective bi-conical elements 82–88. The feed system may connect with electronic circuitry (not shown in FIG. 8), which may be mounted to the array 80.

Figure 9:
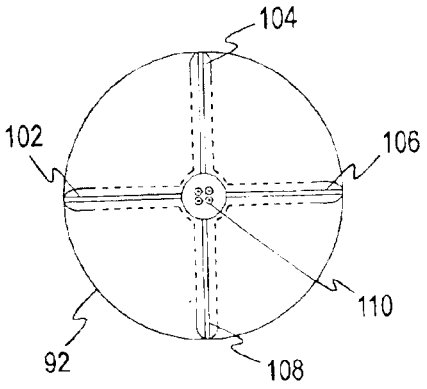
FIG. 9 is a sectional view taken generally in the plane of the line 9—9 of FIG. 8.

The antenna array 80 shown in FIG. 8 may be used for omnidirectional coverage and also for directive beam or directional coverage, such as sector coverage. That is, the array may be used as a directive beam antenna. Referring to FIGS. 8 and 9, a version useful for defining four sectors and four directive beams is illustrated. The sectors of array 80 are formed by reflective sector walls 102, 104,106, 108 which divide the bi-conical elements 82–88 into defined sectors. In the illustrated embodiment, four walls 102–108 are used and each sector is generally a 90° sector (see FIG. 9). A greater or lesser number of walls might also be used to define other sector sizes. For omnidirectional operation, the signals from the various sectors may be added together. When divided into sectors, in one embodiment of the invention, each sector is fed by a traveling wave feed, as illustrated by the coaxial cables 110 in FIG. 9, and discussed below.

As noted, other variations are possible without departing from the scope of the invention. For example, an omnidirectional antenna only (with no sector dividing walls) or walls for forming 2, 3, or 5 or more sectors might be used. FIG. 9 illustrates a feed comprising four separate coaxial cable elements 110 running generally axially through space 100 of the array for coupling with the respective bi-conical reflector elements. The cables are used as slotted coaxial line feeds for the defined sectors, as discussed hereinbelow.

Figure 11:
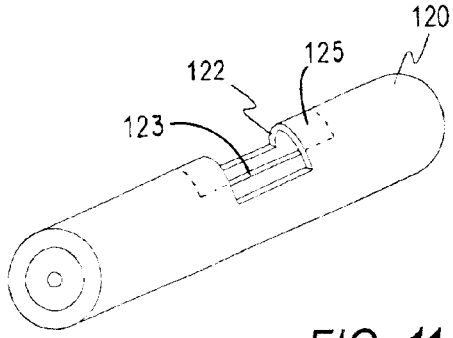
FIG. 11 is a partial sectional view of a coaxial feed cable which may be utilized in connection with the antenna embodiment of FIG. 8.
Figure 10:
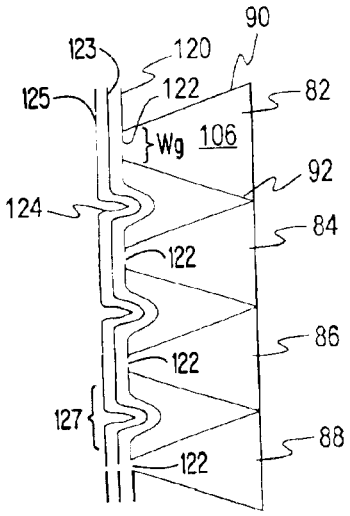
FIG. 10 is a partial side section view taken generally in the plane of the line 10—10 of FIG. 8.
Figure 12:
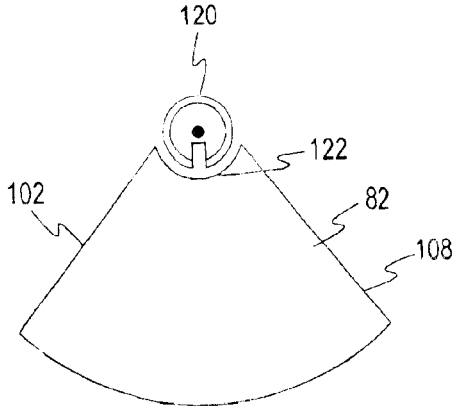
FIG. 12 is a partial sectional view, similar to FIG. 9, showing the feed cable of FIGS. 10 and 11.

As shown in FIGS. 10–12, coaxial cables are used to form a feed system for the array 80. For example, a single coaxial cable may be used to form a single traveling wave feed configuration for each sector. Referring to FIG. 11, the coaxial cable 120 which may be used for a particular sector is slotted at positions along the cable length where it intersects the respective bi-conical reflectors or feed element 82–88, etc. to achieve aperture coupling therewith. These slots are indicated in the Figures generally by the reference numeral 122. The slots 122 expose the center conductor 123 and part of the shield 125 for coupling electrically to the array elements 82–88 to form the feed system. The cables are positioned along the length of the array as illustrated in FIG. 10. For example, the cables 120 may be positioned in space 100 of array 80 along its length. FIG. 10 shows one sector of the array 80 and a single cable 120 forming a traveling wave feed. FIG. 9 illustrates four cables 110 for the four defined sectors of the illustrated embodiment. Referring again to FIG. 10, the slots 122 formed in the cables are aligned with the defined apertures of the bi-conical elements 82–88 for each of the elements.

Direct electrical connections may be made between the cables and bi-conical elements suitably for propagating signals, such as by soldering the exposed center conductor 123 and shield portions 125 to the elements 82–88 proximate to the center area 100 of each element. Alternatively, capacitive electrical coupling may be used between the slotted cables 120 and the elements 82–88.

It is desirable that the elements 82–88 are excited in phase. As indicated in FIG. 10, the cable 120 of the slotted coaxial-line feed may include a bent or curved section 127 along its length and intermediate the reflectors, as indicated, for example, at reference numeral 124, to achieve the desired phasing by introductory delays. Alternatively, the cables may not be bent.

Alternatively, the sector arrays formed by the antenna 80, as described above, could use corporate beamforming; for example, one coaxial line or a printed circuit line to each element. Coaxial lines 110 are shown in FIG. 9. For the traveling wave feed arrangement of FIGS. 10–12, element loading (i.e., conductance) on the feedlines 120 may be controlled either by the length of the slot 122 formed in the coaxial cable 120, or by the reflector spacing $W_g$, as shown in FIG. 10. The elevation beamwidth of the illustrated antenna in FIGS. 9–12 is an elevation beam with approximately 40° and a sector beamwidth of approximately 100°.

FIG. 12 illustrates a top cross-section view of a single sector for a reflector element 82 of the array 80 showing the slotted coaxial feed cable 120 feeding the sector.

Figure 13:
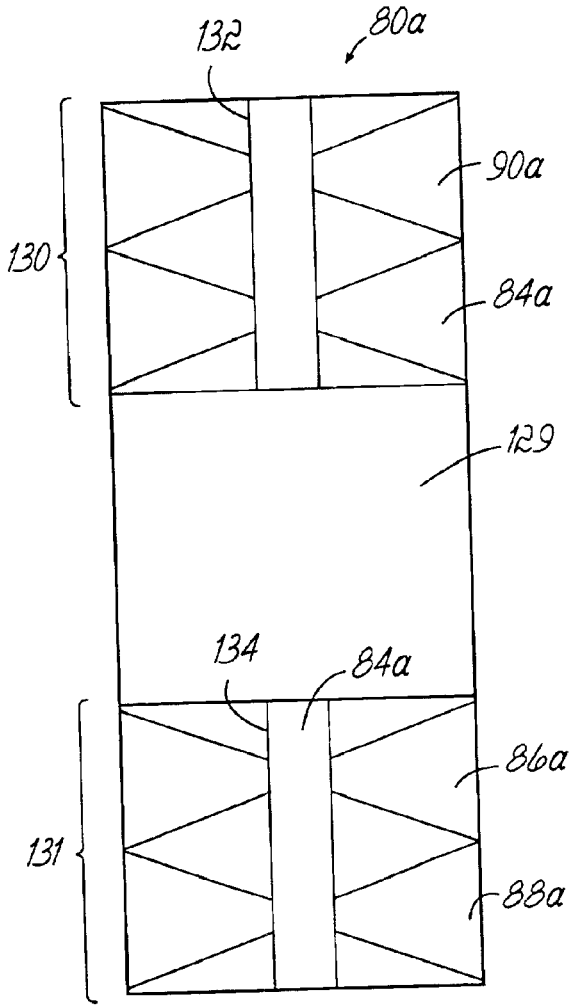
FIG. 13 is a side cross-sectional view of an alternative embodiment of an antenna system.
Figure 14:
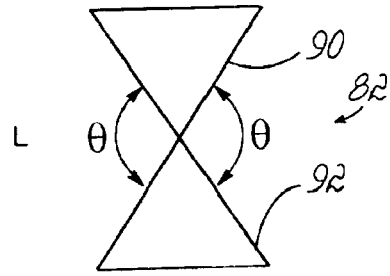
FIG. 14 is a schematic illustrational view of an antenna for use in embodiments of the present invention.

In the embodiment shown in FIGS. 13 and 14, like elements and components from FIGS. 8–12 have been designated with like reference numerals with the suffix "a." The bi-conical elements 82*a*, 84*a* and 86*a*, 88*a* of frusto-conical portions 90*a*, 92*a*, defined as pairs and separated axially by an electronics enclosure and/or feed network housing or section 129. In that way, separated arrays 130, 131 are formed. Additionally, tubular elongate elements 132 and 134 may be placed within the hollow center sections 100 of the pairs 82*a*, 84*a*, and 86*a*, 88*a* of bi-conical elements. The feed lines, such as the coaxial feed lines, may run inside the tubular elements 132, 134.

FIG. 14 shows a cross-sectional schematic view of an antenna element, such as element 82. Although the embodiments illustrated herein show an antenna array 80 which utilizes four elements 82–88, a greater or lesser number of elements might also be utilized within a given length of the array. To that end, the individual elements 82–88, may have length dimensions "L." The length dimensions "L" may be varied, by varying the cone angle, θ, as illustrated in FIG. 14. Therefore, the number of elements which are utilized to excite an aperture of a given length may be varied by changing the cone angle θ of the elements.

The embodiment illustrated in FIG. 13 can operate as an omnidirectional antenna array 80*a*–88*a*, or may be divided by reflector walls, as illustrated in FIGS. 8 and 9 for defining individual sectors. To that end, the arrays 130 and 131, illustrated in FIG. 13, might have different functions. For example, the array 130 might be utilized as an omnidirectional antenna, whereas the array 131 might utilize sector walls to form directed beams. The converse arrangement might also be utilized. The embodiment illustrated in FIG. 13 also has additional advantages. By splitting the two arrays into arrays separated by the space 129, there is some isolation provided between the arrays. Furthermore, there will generally be less loss using the same array for simultaneous transmit and receive, and appropriate combiner/splitter electronics.

Figure 15:
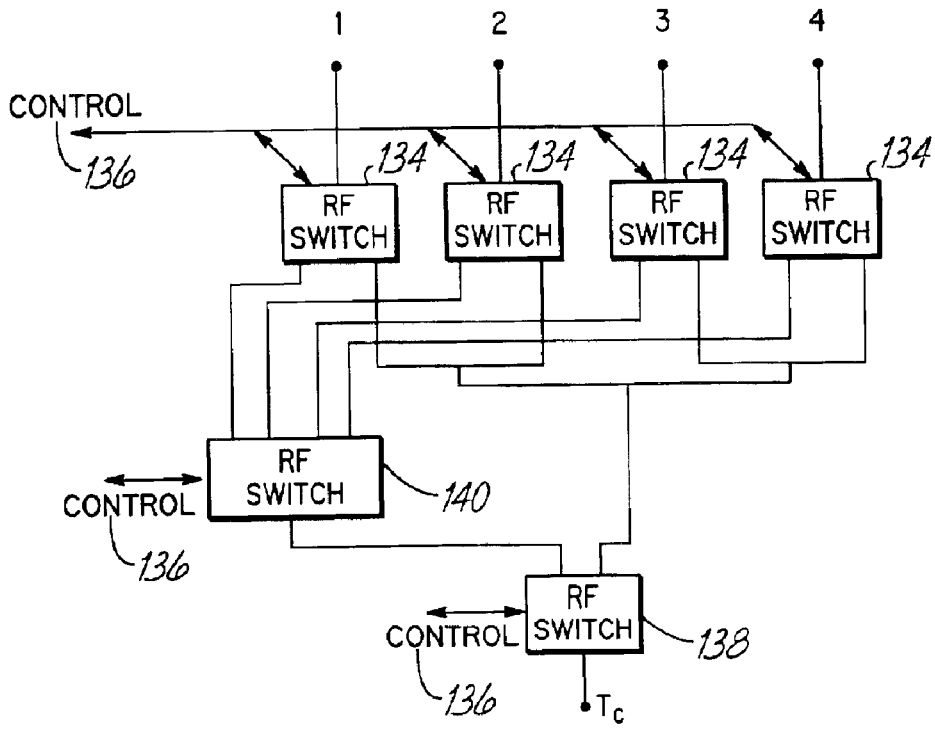
FIGS. 15 and 16 illustrate beamsteering or beam selection systems which may be used in accordance with aspects of the invention for the embodiment of FIG. 8.

FIG. 15 illustrates a control system for controlling the arrays 80, 130, 131 in accordance with their various directional and omnidirectional aspects of the invention. Specifically, the control system provides for switched operation between directional and omnidirectional coverage. The control system indicates inputs from 4 sectors or columns defined by an array which feed to RF switches 134. For omnidirectional aspects, the switches are controlled by an appropriate control system and requisite signals 136 to select the signals of all sectors 1–4. The combined signals are fed to another RF switch 138 for switching to an appropriate transceiver Tc per controls 136. For selected directional aspects, the switches 134 route the directional signals of the sectors 1–4 to an RF switch 140. With switch 138, a particular sector or column may be selected via controls 136 to route to transceiver Tc through switch 138.

Figure 16:
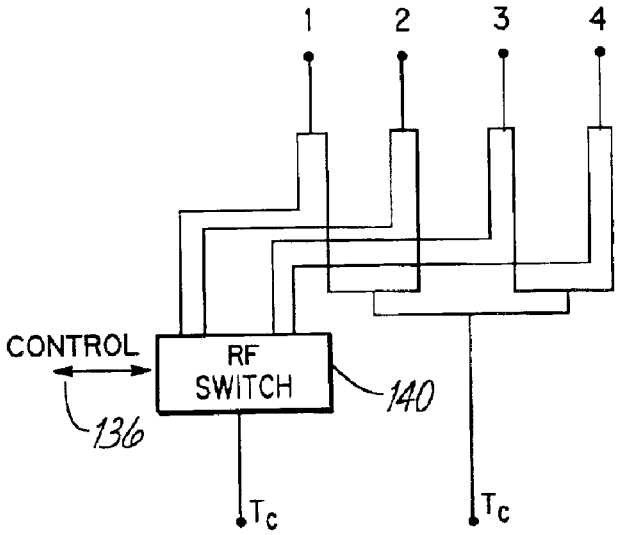

FIG. 16 provides for simultaneous operation of omnidirectional and directional coverage of the arrays 80, 130, 131. To that end, the signals from the sectors/columns 1–4 are combined directly and routed to a transceiver Tc. The outputs from the sectors/columns 1–4 are also simultaneously routed to RF switch 140 for selecting a directional beam via controls 136. The selected beam is also routed to a transceiver Tc.

As will be understood by a person of ordinary skill in the art, multiple sectors or beams might be selected and combined, such as using a system similar to those shown in FIGS. 4A and 4B.

The antennas of the present invention for providing both omnidirectional and directed beam or beam forming aspects may have antennas 22, 24 or elements 82–88, which operate at a similar frequency band. Alternatively, the omnidirectional antenna may be operated at one band, while the directed beam antenna is operated at another band. In still another alternative, the various antennas of the inventive system may be operated each or both at multiple bands, for multi-frequency band operations.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An antenna system comprising a unitary structure having a plurality of antennas including an antenna with a plurality of individual antenna elements which collectively define a beam for directional beam coverage and a dipole antenna configured to provide omnidirectional beam coverage, the dipole antenna forming a ground plane for said individual antenna elements.

2. The antenna system of claim 1 wherein said antenna elements include patch antenna elements.

3. The antenna system of claim 2, said patch antenna elements being mounted on a tubular support surface surrounding said dipole antenna.

4. The antenna system of claim 3 wherein the dipole antenna is tubular, said tubular support surface being of similar cross-sectional configuration to said tubular dipole antenna and of lesser axial length than said dipole element.

5. The antenna system of claim 3 wherein said patch antenna elements comprise an M by N array of rows and columns of patch elements.

6. The antenna system of claim 5 wherein the patch antenna elements in one of said rows and columns are arranged in evenly spaced fashion on said tubular support surface.

7. The antenna system of claim 5 wherein the patch antenna elements in one of said rows and columns are arranged in a staggered fashion on said tubular support surface.

8. The antenna system of claim 1 wherein said dipole antenna comprises at least one pair of tubular arms arranged generally coaxially and separated by a gap.

9. The antenna system of claim 8 wherein said dipole antenna further includes at least one tubular end section of similar cross-section configuration to said tubular arms and located adjacent an end of at least one of said tubular arms to define capacitive end loading for said dipole antenna.

10. The antenna system of claim 6 wherein said tubular arms are cylindrical.

11. The antenna system of claim 8 wherein the tubular arms are polygonal in cross-section.

12. The antenna system of claim 1 further comprising a beam selecting system coupled to said plurality of antenna elements.

13. The antenna system of claim 1 further comprising a control system coupled for selectively controlling the directional beam coverage and omnidirectional beam coverage of the antenna system.

14. The antenna system of claim 13 wherein said control system is operable for selectively choosing directional beam and omnidirectional beam coverage one of simultaneously and exclusively.

15. The antenna system of claim 13 wherein the directional beam coverage includes a plurality of directional beams, the control system operable for selecting one or more beams from said plurality of antennas.

16. The antenna system of claim 1 wherein the dipole antenna comprises a plurality of dipole elements positioned end to end.

17. The antenna system of claim 16 wherein said dipole elements are tubular.

18. The antenna system of claim 16 wherein at least one of the dipole elements includes tubular dipole arms.

19. An antenna system comprising a unitary structure having a plurality of antennas, said antennas being configured to provide both directional beam coverage and omnidirectional beam coverage, wherein at least one of said antennas comprises a bi-conical reflector element.

20. The antenna system of claim 19 wherein said bi-conical reflector element includes frusto-conical reflector portions.

21. The antenna system of claim 19 further comprising a plurality of bi-conical reflector elements positioned end to end and aligned generally coaxially.

22. The antenna system of claim 19 further comprising a feed structure extending through a central passageway of the bi-conical reflector element.

23. The antenna system of claim 22 wherein said feed structure comprises a coaxial cable with an aperture therein coupled to a reflector element to define a traveling wave feed configuration.

24. The antenna system of claim 23 wherein said feed structure comprises a plurality of coaxial cables, one for each reflector element.

25. The antenna system of claim 19 further comprising at least one reflective wall for dividing the reflector element into a plurality of sectors to define directional beams.

26. The antenna system of claim 19 further comprising a plurality of bi-conical reflector elements positioned end to end and aligned generally coaxially, at least one of the bi-conical reflector elements being spatially separated from another of the reflector elements.

27. An antenna structure having a plurality of antenna elements and configured and oriented to achieve both relatively narrow directional beam coverage and relatively wide omnidirectional beam coverage and including a relatively narrow coverage directional beam antenna having a ground plane, said ground plane being configured to serve as a relatively wide coverage omnidirectional antenna.

28. The antenna structure of claim 27 wherein said plurality of antenna elements are configured for simultaneously providing both omnidirectional and directional beam coverage.

29. The antenna structure of claim 27 wherein said relatively narrow coverage antenna comprises a plurality of discretely excitable antenna elements.

30. The antenna structure of claim 27 wherein the relatively narrow coverage directional beam antenna and relatively wide coverage antenna are tubular.

31. The antenna structure of claim 30 wherein said tubular antennas are concentric.

32. The antenna structure claim 27 wherein the relatively narrow directional beam antenna and relatively wide omnidirectional beam antenna are adapted to be excited simultaneously or separately in time.

33. An antenna structure comprising concentric inner and outer cylindrical antennas, the outer antenna including an array of antenna elements which collectively operate together, the inner cylindrical antenna acting as a ground plane for the antenna elements of the outer cylindrical antenna.

34. The antenna structure of claim 33 wherein the cross-section of the inner and outer antennas is one of circular and polygonal.

35. An antenna structure comprising:

inner and outer antennas which define a central space therein;

antenna electronics located in said central space.

36. An antenna structure comprising coaxial cylindrical inner and outer antennas adapted to be excited directly and non-antenna coaxial cylindrical cap structures axially positioned at opposing ends of the inner antenna the cylindrical cap structures being capacitively coupled to the inner antenna to create a capacitive loading on said inner antenna.

37. A method of sending and receiving radio frequency signals comprising, with a unitary structure having a plurality of antennas, utilizing an antenna with a plurality of individual antenna elements to collectively provide directional beam coverage and an antenna to provide omnidirectional beam coverage, the omnidirectional antenna defining a ground plane for the directional antenna.

38. The method of claim 37 further comprising exciting the plurality of antenna elements for providing directional beam coverage and exciting a dipole antenna for providing omnidirectional beam coverage.

39. The method of claim 37 wherein said omnidirectional antenna and directional antenna include concentric tubular elements.

40. The method of claim 37 further comprising operating the antennas to provide both directional beam coverage and omnidirectional beam coverage simultaneously.

41. The method of claim 37 further comprising operating the antennas to selectively provide one of the directional beam coverage and omnidirectional beam coverage.

42. The method of claim 37 further comprising positioning a plurality of antenna elements on a cylindrical support structure as an M by N array of elements arranged in evenly spaced or staggered rows and columns.

43. The method of claim 42 and further including selectively utilizing the antenna elements of the array to define individual directional beams with the array.

44. The method of claim 43 further comprising selecting one or more of the individual directional beams.

45. The method of claim 37 further comprising selecting said omnidirectional beam coverage either independently of or simultaneously with, selection of said directional beam coverage.

46. The method of claim 37 further comprising exciting a dipole antenna for providing omnidirectional beam coverage.

47. A method of sending and receiving radio frequency signals comprising exciting an element including a pair of frusto-conical reflector portions for providing directional beam coverage and omnidirectional beam coverage.

48. The method of claim 47 further comprising dividing the element into individual sectors for providing directional beam coverage.

49. The method of claim 48 further comprising selecting at least one of said sectors.

50. The method of claim 47 further comprising exciting the element with a coaxial cable having an aperture coupled to the reflector portions to define a traveling wave feed structure.

* * * * *